US008544259B2

(12) United States Patent
Tsujimoto et al.

(10) Patent No.: US 8,544,259 B2
(45) Date of Patent: Oct. 1, 2013

(54) EXHAUST PURIFICATION SYSTEM OF INTERNAL COMBUSTION ENGINE

(75) Inventors: Kenichi Tsujimoto, Susono (JP); Mikio Inoue, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 11 days.

(21) Appl. No.: 13/322,334

(22) PCT Filed: Sep. 18, 2009

(86) PCT No.: PCT/JP2009/066846
§ 371 (c)(1),
(2), (4) Date: Nov. 23, 2011

(87) PCT Pub. No.: WO2011/033681
PCT Pub. Date: Mar. 24, 2011

(65) Prior Publication Data
US 2012/0090302 A1 Apr. 19, 2012

(51) Int. Cl.
*F01N 3/38* (2006.01)

(52) U.S. Cl.
USPC ..... 60/286; 60/291; 60/295; 60/300; 60/303; 60/317; 60/320

(58) Field of Classification Search
USPC ..... 60/282, 286, 287, 291, 295, 297, 60/299, 300, 301, 303, 311, 317, 320, 324
See application file for complete search history.

(56) References Cited

U.S. PATENT DOCUMENTS

| | | | | |
|---|---|---|---|---|
| 5,425,233 | A | 6/1995 | Ma et al. | |
| 2003/0014966 | A1 | 1/2003 | Hirota et al. | |
| 2007/0220873 | A1 * | 9/2007 | Bosteels | 60/299 |

FOREIGN PATENT DOCUMENTS

| | | |
|---|---|---|
| JP | A-6-117239 | 4/1994 |
| JP | A-6-508409 | 9/1994 |
| JP | A-2001-123825 | 5/2001 |
| JP | A-2006-291813 | 10/2006 |
| JP | A-2007-16613 | 1/2007 |

OTHER PUBLICATIONS

International Search Report dated Dec. 1, 2009 in International Application No. PCT/JP2009/066846.

* cited by examiner

*Primary Examiner* — Thomas Denion
*Assistant Examiner* — Jorge Leon, Jr.
(74) *Attorney, Agent, or Firm* — Oliff & Berridge, PLC

(57) ABSTRACT

An exhaust purification system of an internal combustion engine is provided with an exhaust treatment device which purifies exhaust, a fuel feed device which is arranged at an upstream side from the exhaust treatment device and which feeds fuel to the engine exhaust passage, an ignition device which causes fuel which is fed from the fuel feed device to ignite, and a flow regulating device which regulates the flow rate of exhaust gas which flows toward the ignition device. The fuel feed device is formed so as to feed liquid fuel. The system has an operating region in which due to the fuel which is fed to the engine exhaust passage burning, backflow of the exhaust gas occurs. Fuel is made to burn in the operating region. Further control is performed to make the flow rate of the exhaust gas increase during the period from when combustion of fuel should be started to when combustion of the fuel ends.

7 Claims, 9 Drawing Sheets

EXHAUST PURIFICATION SYSTEM OF INTERNAL COMBUSTION ENGINE

TECHNICAL FIELD

The present invention relates to an exhaust purification system of an internal combustion engine.

BACKGROUND ART

The exhaust gas of a diesel engine or gasoline engine or other internal combustion engine, for example, contains carbon monoxide (CO), unburned fuel (HC), nitrogen oxides ($NO_x$), particulate matter (PM), etc.

An internal combustion engine is provided with an exhaust treatment device for removing these constituents. The exhaust treatment device includes an oxidation catalyst for oxidizing the carbon monoxide etc., an $NO_x$ storage reduction catalyst or $NO_x$ selective reduction catalyst for removing the nitrogen oxides, a particulate filter for removing particulate matter, etc.

To raise the temperature of the exhaust treatment device which is arranged in the engine exhaust passage, it is known to make the unburned fuel burn in the engine exhaust passage. Japanese Patent Publication (A) No. 06-117239 discloses a catalyst warmup device which is provided with a catalyst converter which is provided in the exhaust system of the internal combustion engine, a spark plug which is arranged upstream of the catalyst converter of the exhaust system, and a hydrogen generation device for feeding hydrogen near the spark plug. It is disclosed that in this catalyst warmup device, when the catalyst temperature of the catalyst converter becomes a predetermined value or less, hydrogen is fed to near the spark plug and is ignited.

CITATION LIST

Patent Literature

PLT 1 Japanese Patent Publication (A) No. 06-117239

SUMMARY OF INVENTION

Technical Problem

By making the fuel burn at the upstream side from the exhaust treatment device in the engine exhaust passage, it is possible to raise the temperature of the exhaust treatment device in a short time. By making the fuel burn, it is possible to raise the temperature of the exhaust gas and use the high temperature exhaust gas to raise the temperature of the exhaust treatment device. For example, to burn the fuel at the upstream side of the oxidation catalyst, it is possible to raise the temperature of the oxidation catalyst to the activation temperature or more in a short time.

The fuel which is fed to the engine exhaust passage is preferably made to completely burn. If the fuel incompletely burns, sometimes smoke containing black smoke etc. is produced. In particular, when using diesel oil or other liquid fuel as fuel, the combustion speed of the liquid fuel is slow. For this reason, incomplete combustion of fuel etc. occurs and sometimes smoke is produced. To make the liquid fuel sufficiently burn, it is preferable to make the liquid fuel burn in a sufficiently aerated state. In this regard, there is the problem that since the engine exhaust passage is lower in temperature compared with the combustion chambers etc., vaporization is difficult.

Further, when injecting liquid fuel into the engine exhaust passage, the fuel is fed as drops of liquid. At this time, compared to when injecting fuel into the combustion chambers, a smaller pressure can be used to inject the fuel. However, since the pressure of injection of the fuel is small, the particle size of the liquid drops becomes larger. For example, the particle size of the liquid drops of fuel which are fed to the engine exhaust passage becomes larger than the particle size of the liquid drops of fuel which is fed to the combustion chambers. The fuel which is injected into the engine exhaust passage has the characteristic of being hard to vaporize. For this reason, sometimes the fuel does not sufficiently burn and smoke is generated.

Further, smoke cannot be suppressed by making the fuel sufficiently react with oxygen. However, when feeding liquid fuel to the engine exhaust passage, even if there is a large amount of oxygen present in the combustion region, sometimes the unburned fuel and the oxygen which is contained in the exhaust gas do not sufficiently react and smoke is generated.

The present invention has as its object the provision of an exhaust purification system of an internal combustion engine which suppresses the production of smoke when making fuel burn in the engine exhaust passage.

Solution to Problem

The exhaust purification system of an internal combustion engine of the present invention is provided with an exhaust treatment device which is arranged in an engine exhaust passage and which purifies exhaust, a fuel feed device which is arranged at an upstream side from the exhaust treatment device and which feeds fuel to the engine exhaust passage, an ignition device which causes fuel which is fed from the fuel feed device to ignite, and a flow regulating device which regulates the flow rate of exhaust gas which flows toward the ignition device. The fuel feed device is formed so as to feed liquid fuel. The system has an operating region in which due to the fuel which is fed to the engine exhaust passage burning, backflow of the exhaust gas occurs. Fuel is made to burn in the operating region in which backflow of the exhaust gas occurs and a control is performed to make the flow rate of the exhaust gas increase during the period from when combustion of fuel should be started to when combustion of the fuel ends.

In the above invention, preferably the flow regulating device is used to decrease the flow rate of the exhaust gas immediately after the feed of fuel is stopped.

In the above invention, preferably the fuel feed device is controlled to intermittently burn the fuel a plurality of times, and the smaller the flow rate of the exhaust gas, the longer the interval between feed of fuel is made.

In the above invention, preferably the fuel feed device is controlled to intermittently burn the fuel a plurality of times, and the smaller the flow rate of the exhaust gas, the smaller the feed amount of fuel is made each time.

In the above invention, preferably the fuel feed device is controlled to intermittently burn the fuel a plurality of times and, when fuel is fed from the fuel feed device and the air-fuel ratio of the exhaust gas flowing into the exhaust treatment device is made the stoichiometric air-fuel ratio or rich, the combustion of fuel the current time is started when combustion of fuel fed the previous time is residually continuing.

In the above invention, preferably the system is provided with an auxiliary member which is arranged at the inside of the engine exhaust passage and which causes a pressure loss of exhaust gas, the ignition device has a heat generating part, the fuel feed device is formed so as to feed fuel toward the heat generating part, and the auxiliary member is arranged at the downstream side of the heat generating part near to the heat generating part.

In the above invention, preferably the system is provided with a rod shaped member which is arranged at the inside of the engine exhaust passage and which extends in the flow direction of the exhaust gas, the ignition device has a heat generating part, the rod shaped member has a cutaway part which has a shape which is partially cut away, the fuel feed device is formed so as to feed fuel toward the heat generating part, and the heat generating part is arranged at the inside of the region in which the cutaway part is formed.

Advantageous Effects of Invention

According to the present invention, it is possible to provide an exhaust purification system of an internal combustion engine which suppresses the production of smoke when making fuel burn in the engine exhaust passage.

DESCRIPTION OF EMBODIMENTS

Embodiment 1

Referring to FIG. 1 to FIG. 7, an exhaust purification system of an internal combustion engine in Embodiment 1 will be explained.

Figure 1:
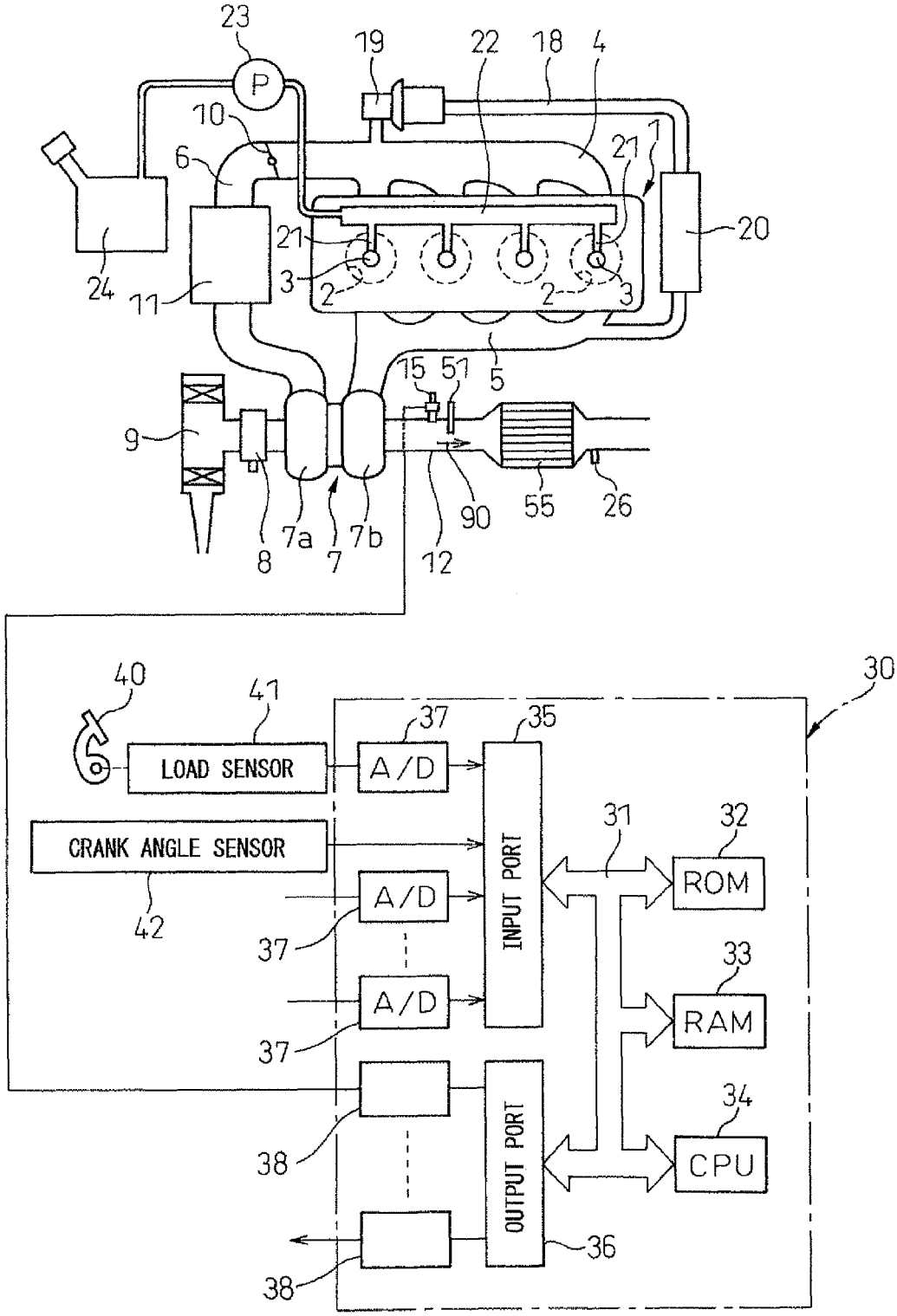
FIG. 1 is a schematic view of an internal combustion engine in Embodiment 1.

FIG. 1 shows an overall view of an internal combustion engine in the present embodiment. In the present embodiment, the explanation will be made with reference to a compression ignition type of engine as an example. The internal combustion engine in the present embodiment is provided with an engine body 1. The engine body 1 includes a combustion chamber 2 of each cylinder, an electronically controlled fuel injection valve 3 for injecting fuel into each combustion chamber 2, an intake manifold 4, and an exhaust manifold 5.

The intake manifold 4 is connected through an intake duct 6 to an outlet of a compressor 7*a* of an exhaust turbocharger. An inlet of the compressor 7*a* is connected through an intake air detector 8 to an air cleaner 9. Inside of the intake duct 6, a throttle valve 10 which is driven by a step motor is arranged. In the intake duct 6, a cooling device 11 is arranged for cooling the intake air which flows through the inside of the intake duct 6. In the embodiment shown in FIG. 1, the engine cooling water is guided to the inside of the cooling device 11 where the engine cooling water is used to cool the intake air.

On the other hand, the exhaust manifold 5 is connected to an inlet of an exhaust turbine 7*b* of the exhaust turbocharger 7. An outlet of the exhaust turbine 7*b* is connected through an exhaust pipe 12 to an exhaust treatment device 55. The exhaust treatment device 55 is a device which is able to purify the exhaust which is discharged from the engine body 1. As the exhaust treatment device 55, an oxidation catalyst, particulate filter, $NO_x$ storage reduction catalyst, $NO_x$ selective reduction catalyst, etc. may be illustrated.

Upstream of the exhaust treatment device 55, as a fuel feed device for feeding unburned fuel to the inside of the engine exhaust passage, a fuel addition valve 15 is arranged. The fuel addition valve 15 is formed so as to have a fuel feed action for feeding or stopping the feed of fuel. Between the fuel addition valve 15 and the exhaust treatment device 55, a glow plug 51 is arranged as an ignition device. The glow plug 51 has the function of igniting the fuel which is injected from the fuel addition valve 15.

Between the exhaust manifold 5 and the intake manifold 4, an EGR passage 18 is arranged for exhaust gas recirculation (EGR). Inside of the EGR passage 18, an electronically controlled EGR control valve 19 is arranged. Further, in the EGR passage 18, a cooling device 20 is arranged for cooling the EGR gas which flows through the inside of the EGR passage 18. In the embodiment shown in FIG. 1, the engine cooling water is guided to the cooling device 20 where the engine cooling water is used to cool the EGR gas.

For each combustion chamber 2, a fuel injection valve 3 is arranged. The fuel injection valve 3 is connected through a fuel feed pipe 21 to a common rail 22. This common rail 22 is connected through an electronically controlled variable discharge fuel pump 23 to a fuel tank 24. The fuel which is stored in the fuel tank 24 is fed by the fuel pump 23 to the inside of the common rail 22. The fuel which is fed to the inside of the common rail 22 is fed through each fuel feed pipe 21 to each fuel injection valve 3.

The electronic control unit 30 includes a digital computer. The electronic control unit 30 in the present embodiment functions as the control device of the exhaust purification system. The electronic control unit 30 is provided with components connected to each other by a bidirectional bus 31 such as a ROM (read only memory) 32, RAM (random access memory) 33, CPU (microprocessor) 34, input port 35, and output port 36.

Downstream of the exhaust treatment device 55, a temperature sensor 26 is arranged for detecting the temperature of the exhaust treatment device 55. An output signal of the temperature sensor 26 is input through a corresponding AD converter 37 to the input port 35. At the engine exhaust passage, any sensor may be arranged to detect the state of the exhaust treatment device.

An output signal of the intake air detector 8 is input through a corresponding AD converter 37 to the input port 35. An accelerator pedal 40 has a load sensor 41 connected to it which generates an output voltage proportional to the amount of depression of the accelerator pedal 40. The output voltage of the load sensor 41 is input through a corresponding AD converter 37 to the input port 35. Furthermore, the input port 35 has a crank angle sensor 42 connected to it which generates an output pulse every time a crankshaft rotates by for example 15°. Due to the output of the crank angle sensor 42, it is possible to detect the speed of the engine body 1.

On the other hand, the output port 36 is connected through corresponding drive circuits 38 to the fuel injection valves 3, a step motor for driving the throttle valve 10, an EGR control valve 19, and a fuel pump 23. Further, the output port 36 is connected through corresponding drive circuits 38 to the fuel addition valve 15 and the glow plug 51. The fuel addition valve 15 and glow plug 51 in the present embodiment is controlled by the electronic control unit 30.

Figure 2:
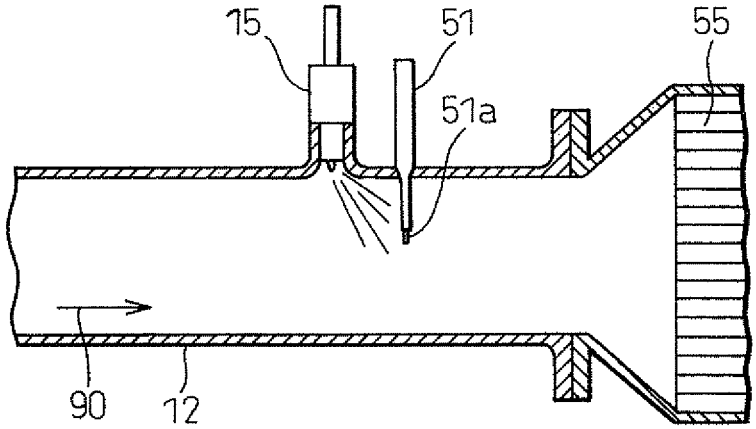
FIG. 2 is an enlarged partial cross-sectional view of a part of a glow plug in an exhaust purification system in Embodiment 1.

FIG. 2 shows an enlarged partial cross-sectional view of the part where the fuel addition valve and the glow plug are arranged in the exhaust purification system of the present embodiment. The exhaust pipe 12 is formed into a tubular shape. The fuel addition valve 15 is arranged at the upstream side of the exhaust treatment device 55 and the glow plug 51. The fuel addition valve 15 in the present embodiment is formed to inject the fuel in a radial manner. Further, the fuel addition valve 15 is formed to inject fuel in a mist. The exhaust purification system in the present embodiment is formed to inject the fuel of the engine body 1, that is, diesel oil, from the fuel addition valve 15. The fuel which is fed to the engine exhaust passage is not limited to this. Fuel other than the fuel of the engine body 1 may also be fed.

The glow plug 51 is arranged to heat fuel which is fed from the fuel addition valve 15. The glow plug 51 has a heat generating part 51*a* which rises in temperature. The heat generating part 51*a* in this example is formed at the front end of the glow plug 51. The fuel addition valve 15 in the present embodiment is formed to inject fuel toward the heat generating part 51*a*. The injection port of the fuel addition valve 15 faces the heat generating part 51*a* of the glow plug 51. The glow plug 51 is arranged at a position where the heat generating part 51*a* contacts the fuel which is injected from the fuel addition valve 15. The glow plug 51 and fuel addition valve 15 in the present embodiment are formed into rod shapes, but the invention is not limited to this. Ones of any shapes may be employed.

The exhaust gas which is exhausted from the engine body 1 flows along the direction of extension of the exhaust pipe 12 as shown by the arrow 90 at the time of ordinary operation.

The exhaust purification system of an internal combustion engine in the present embodiment makes fuel which is fed from the fuel addition valve 15 burn. The exhaust purification system in the present embodiment has an operation region in which fuel which is fed from the fuel addition valve 15 can be burned. The fuel can be burned when the concentration of oxygen in the exhaust gas is a predetermined value or more. Further, if the flow rate of the exhaust gas is too large, the fuel will sometimes not ignite. The fuel can be burned when the flow rate of the exhaust gas is a predetermined value or less. Further, the combustion of the fuel depends also on the temperature of the exhaust gas when ignited. This has the property that the higher the temperature of the exhaust gas, the easier the ignition of the unburned fuel. In this way, it is possible to make the fuel burn under predetermined conditions.

Figure 3:
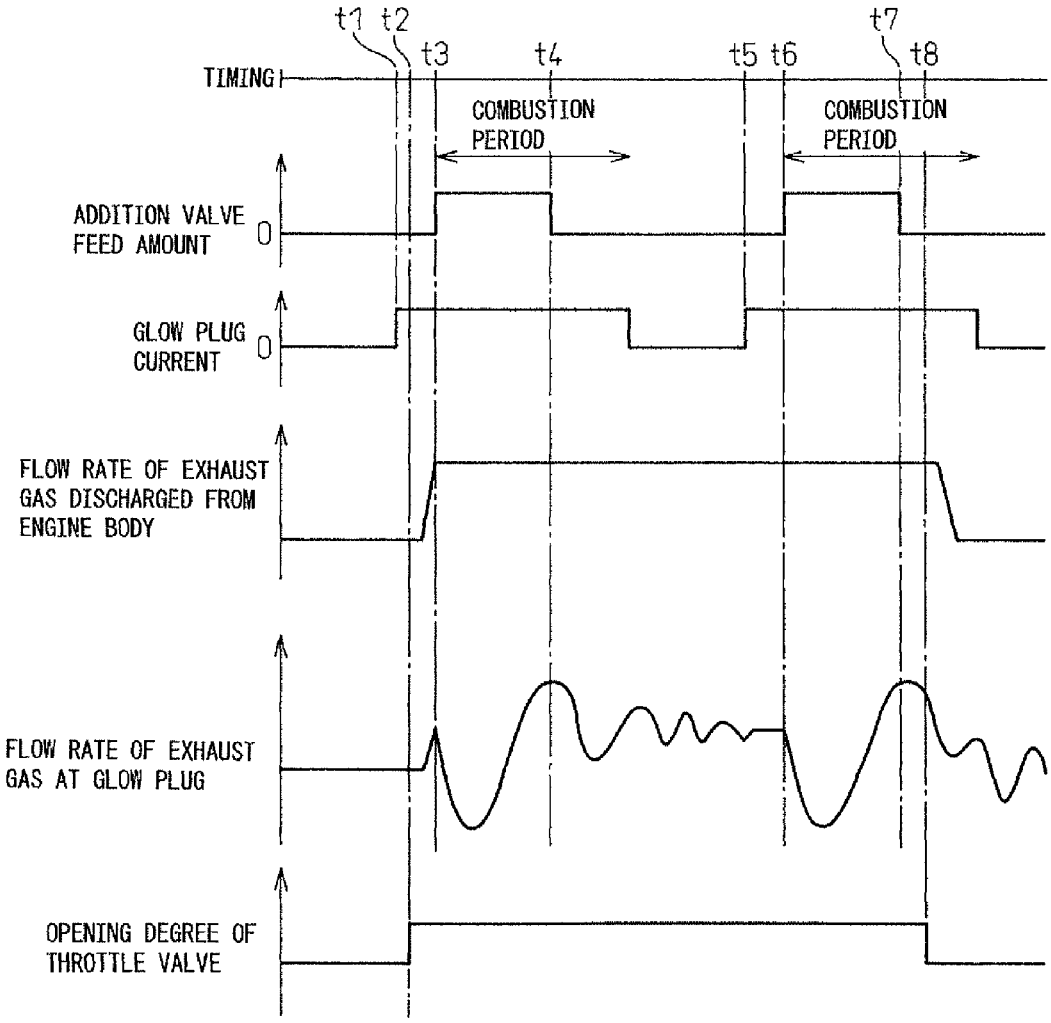
FIG. 3 is a time chart of a first operating control in Embodiment 1.

FIG. 3 is a time chart of first operational control of an exhaust purification system in the present embodiment. Up to the timing $t_1$, ordinary operation is performed. At the time of ordinary operation, the opening degree of the throttle valve is for example the opening degree corresponding to the demanded load. Further, the opening degree of the throttle valve is the opening degree corresponding to the air-fuel ratio at the time of combustion in the combustion chambers.

Before burning the fuel which is fed from the fuel addition valve 15, current starts to be run to the glow plug 51 at the timing $t_1$. Due to current being run through the glow plug 51, the temperature of the heat generating part 51*a* rises. Before igniting the fuel which is fed from the fuel addition valve 15, the glow plug 51 is preheated. In the present embodiment, at the timing $t_3$ at which fuel is ignited, the glow plug 51 is preheated so that the heat generating part 51*a* becomes the temperature at which the unburned fuel can be ignited or higher.

The exhaust purification system in the present embodiment is provided with a flow regulating device which regulates the flow rate of the exhaust gas which flows toward the ignition device. In the present embodiment, the throttle valve 10 which is arranged inside of the engine intake passage functions as a flow regulating device. At the timing $t_2$, the opening degree of the throttle valve 10 is made larger. The opening degree of the throttle valve 10 is made larger to make the flow rate of the air flowing into the combustion chambers 2 increase. Along with this, the flow rate of the exhaust gas which is discharged from the engine body 1 and flows toward the glow plug 51 is increased. The flow rate of the exhaust gas at the glow plug 51 becomes larger. In the present embodiment, the flow rate of the exhaust gas is made to increase in the range of the operating region where fuel which is fed from the fuel addition valve 15 can be ignited.

At the timing $t_3$, fuel is fed from the fuel addition valve 15 to ignite the unburned fuel. Fuel is burned inside of the exhaust pipe 12.

Figure 4:
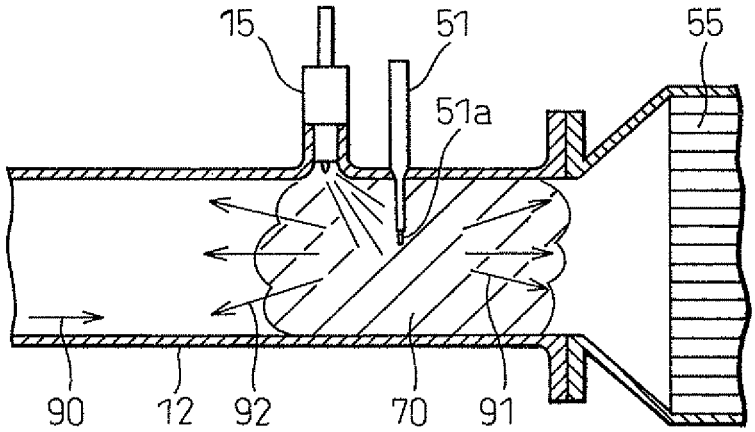
FIG. 4 is an enlarged partial cross-sectional view of a part of a glow plug in an exhaust purification system in Embodiment 1.

FIG. 4 is an enlarged partial cross-sectional view at a part of a glow plug after the unburned fuel is ignited. Combustion is started from near the heat generating part 51*a* of the glow plug 51. The exhaust gas around the heat generating part 51*a* expands. At the downstream side of the glow plug 51, as shown by the arrows 91, the combustion gas proceeds toward the exhaust treatment device 55. At the upstream side of the glow plug 51, as shown by the arrows 92, the combustion gas flows back against the ordinary flow of the exhaust gas.

Referring to FIG. 3, in the first operational control, the feed of fuel from the fuel addition valve 15 is continued from the timing $t_3$ to the timing $t_4$. While the fuel addition valve 15 is feeding fuel, the fuel is burned. Further, even right after the fuel addition valve 15 stops feeding fuel, unburned fuel remains at the upstream side from the glow plug 51, so the combustion continues. In the operational example shown in FIG. 3, current is run through the glow plug in the combustion period during which combustion of fuel continues.

Near the glow plug 51, right after the timing $t_3$ at which the fuel is ignited, the pressure rapidly rises. For this reason, the flow rate of the exhaust gas temporarily falls. That is, the flow rate becomes smaller due to the rapid expansion of the exhaust gas when starting combustion of fuel. At the upstream side from the glow plug 51, the rise in pressure is accompanied with backflow of the exhaust gas. The backflow exhaust gas strikes the exhaust gas which was exhausted from the engine body 1. As a result, in the engine exhaust passage, pulsation of the flow rate of the exhaust gas occurs. In first operational control, the pulsation starts from the timing $t_3$. The pulsation of the flow rate of the exhaust gas is attenuated along with time and converges to a predetermined flow rate.

In the first operational control, combustion of the fuel is repeated from the timing $t_6$. From the timing $t_6$ to the timing $t_7$, fuel is again fed. In the first operational control, fuel is fed intermittently from the fuel addition valve a plurality of times. During the period of burning fuel a plurality of times, the state of increase of the flow rate of the exhaust gas is maintained. In the example shown in FIG. 3, the opening degree of the throttle valve 10 is maintained from the timing $t_1$ to the timing $t_8$. At the timing $t_8$, the opening degree of the throttle valve 10 is made smaller. The flow rate of the exhaust gas which is discharged from the engine body 1 becomes smaller.

In this way, it is possible to make the fuel which is fed from the fuel addition valve 15 burn. In the example shown in FIG. 3, fuel is fed two times from the fuel addition valve 15, but the invention is not limited to this. The fuel may also be fed from the fuel addition valve a single time. Alternatively, the fuel may be fed from the fuel addition valve three times or more.

By making the fuel burn in the engine exhaust passage at the upstream side from the exhaust treatment device 55, it is possible to raise the temperature of the exhaust gas. The high temperature exhaust gas may be used to raise the temperature of the exhaust treatment device 55 in a short time. For example, when the exhaust treatment device 55 includes an oxidation catalyst, at the time of startup of the internal combustion engine etc., the exhaust treatment device 55 can be raised in temperature to the activation temperature or more in a short time. Alternatively, when the exhaust treatment device 55 includes a particulate filter, to make the particulate matter which is built up at the particulate filter burn off, it is possible to raise the temperature to the target combustion temperature in a short time.

In the first operational control of the present embodiment, when the unburned fuel which is fed from the fuel addition valve should be ignited, that is, right before the fuel is ignited, the flow rate of the exhaust gas is made to increase. It is possible to start the combustion to increase the pulsation which occurs. It is possible to greatly disturb the flow of the exhaust gas in the engine exhaust passage and possible to sufficiently mix the fuel and the exhaust gas. It is possible to bring the burning fuel into contact with a large amount of oxygen and improve the combustibility of the fuel. Further, the fuel and the exhaust gas are more effectively stirred, the vaporization of the fuel can be promoted, and the combustibility of the fuel is improved. As a result, the production of smoke can be suppressed.

In this regard, the characteristic when the exhaust gas flows back depends on the operating state of the internal combustion engine. For example, if the flow rate of the exhaust gas becomes too large, sometimes no backflow occurs when the fuel burns. When the fuel is made to burn, it is preferable to make the fuel burn in the operating region of less than a predetermined flow rate of the exhaust gas. In the present embodiment, the flow rate of the exhaust gas is made to increase in the operating region where backflow occurs when fuel is burned.

Figure 5:
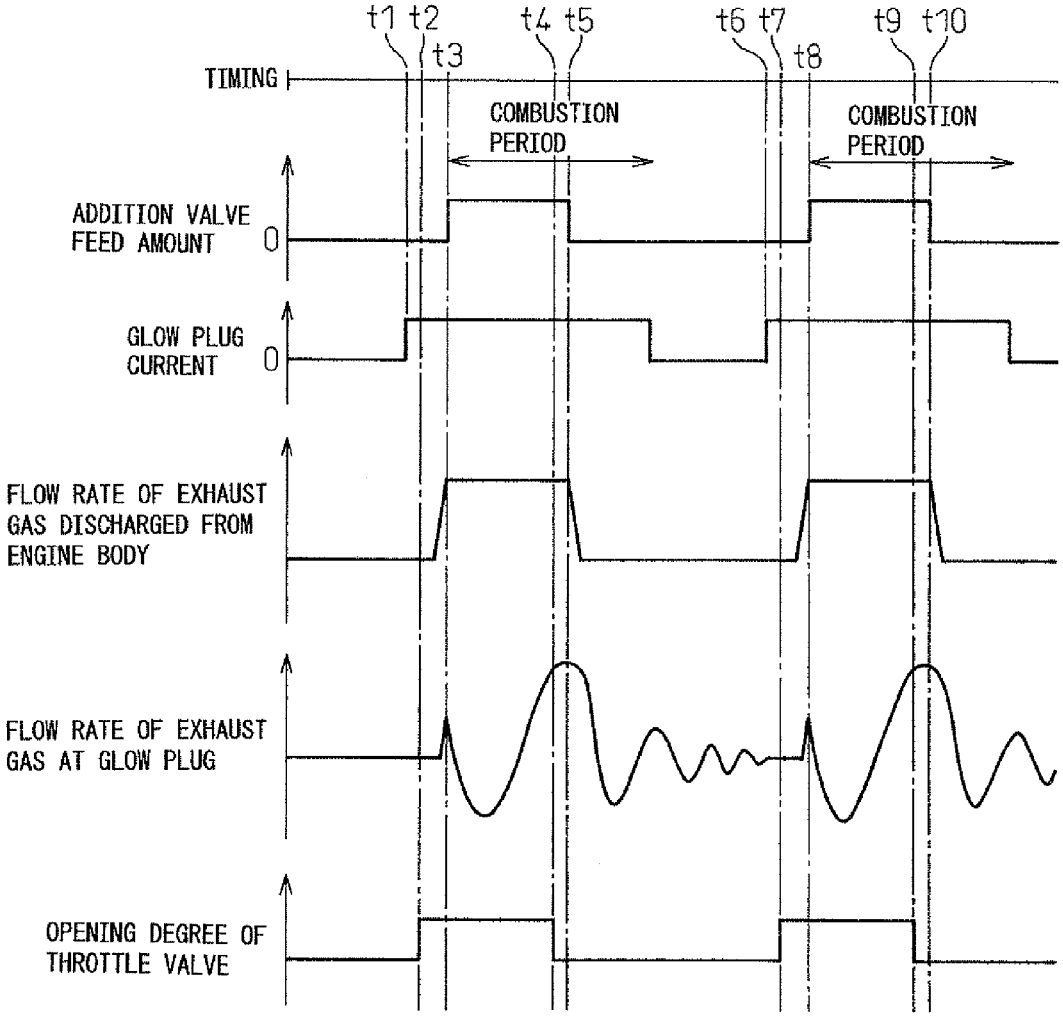
FIG. 5 is a time chart of a second operating control in Embodiment 1.

FIG. 5 shows the time chart of the second operational control in the present embodiment. At the timing $t_1$, current starts to be run to the glow plug 51. At the timing $t_2$, the opening degree of the throttle valve 10 is increased to make the flow rate of the exhaust gas which flows toward the glow plug 51 increase. At the timing $t_3$, the feed of the fuel from the fuel addition valve 15 is started. The unburned fuel is ignited and the combustion is started. At the timing $t_5$, the feed of fuel is stopped.

In the second operational control, the flow rate of the exhaust gas which flows toward the glow plug right after the feed of fuel from the fuel addition valve 15 is stopped is reduced. In the present embodiment, a predetermined time is required from the time when changing the opening degree of the throttle valve 10 to the time when the flow rate of the exhaust gas changes. For this reason, at the timing $t_4$ before the timing $t_5$, the opening degree of the throttle valve 10 is reduced. At the timing $t_5$, the flow rate of the exhaust gas which is discharged from the engine body 1 starts to be decreased. At the second or later fuel combustion operations, control similar to the timing $t_1$ to the timing $t_5$ is repeated from the timing $t_6$ to the timing $t_{10}$.

In the second operational control, each time one feed operation of fuel is stopped, the flow rate of the exhaust gas which flows toward the glow plug is reduced. By reducing the flow rate of the exhaust gas, in addition to pulsation due to expansion of the exhaust gas when the unburned fuel is burned, pulsation derived from fluctuation of the flow rate of the exhaust gas which flows toward the glow plug is added. It is possible to increase the pulsation of the exhaust gas. For this reason, the flow of the exhaust gas is greatly disturbed and the exhaust gas and unburned fuel can be mixed more effectively. As a result, it is possible to more effectively suppress the production of smoke.

In the first operational control and the second operational control, when the combustion of fuel should be started, that is, right before feed of unburned fuel, the flow rate of the exhaust gas which flows toward the glow plug is increased, but the invention is not limited to this. At the same time as starting the combustion of the fuel or during the period when the fuel is burned, the flow rate of the exhaust gas may be increased. For example, after starting the combustion in the operating region where backflow of the exhaust gas occurs, it is possible to increase the flow rate of the exhaust gas. In particular, after stopping the feed of fuel from the fuel addition valve, it is also possible to make the flow rate of exhaust gas increase in the period where combustion of fuel residually continues in the engine exhaust passage. By this control as well, it is possible to disturb the flow of the exhaust gas and suppress the production of smoke. Further, in the above embodiment, the flow rate of the exhaust gas is increased one time, but the invention is not limited to this. It is also possible to increase the flow rate several times.

In the first operational control and the second operational control, the fuel is intermittently burned a plurality of times. In the combustion of the fuel, it is possible to feed the fuel by one operation instead of feeding the fuel a plurality of operations. For example, it is possible to perform the two fuel combustion operations shown in FIG. 3 at one time. By feeding fuel intermittently from the fuel addition valve 15 divided into a plurality of operations, it is possible to repeat the generation of a large pulsation when the fuel is ignited. As a result, it is possible to more effectively suppress the production of smoke.

In this regard, when intermittently burning fuel by a plurality of operations, the backflow combustion gas in the combustion gas produced returns past the glow plug 51 after the elapse of a predetermined time. Referring to FIG. 4, as shown by the arrow 92, the combustion gas which proceeds toward the upstream side along with combustion of the fuel changes direction at a predetermined position and returns past the glow plug 51 after the elapse of a predetermined time. After stopping the feed of fuel and until the combustion gas returns past the glow plug 51, the concentration of oxygen at the glow plug 51 becomes lower. For this reason, preferably, when intermittently burning the fuel a plurality of times, substantially all of the combustion gas which proceeds to the upstream side from the glow plug 51 returns past the glow plug 51, then the next fuel is burned.

When the fuel should be ignited, if the flow rate of the exhaust gas at the glow plug 51 is small, the backflow combustion gas proceeds to a position far away from the glow plug 51. It takes a long time for substantially all of the combustion gas which proceeds to the upstream side from the glow plug 51 to return past the glow plug 51. For this reason, preferably, the smaller the flow rate of the exhaust gas when the unburned fuel should be ignited, the longer the interval between feed operations of fuel should be controlled. For example, referring to FIG. 3, preferably, the smaller the flow rate of the exhaust gas, the longer the time period from the end timing $t_4$ of the feed of fuel of one operation to the start timing $t_6$ of the next combustion of fuel. By performing this control, it is possible for substantially all of the combustion gas which proceeds to the upstream side from the glow plug to return past the glow plug, then the next fuel is burned. It is possible to more effectively suppress the production of smoke.

In the present embodiment, the relationship between the flow rate of the exhaust gas and the interval between fuel feed operations is stored in the ROM 32 of the electronic control unit 30. The exhaust purification system can detect the flow rate of the exhaust gas and set the interval between fuel feed operations based on the detected flow rate of the exhaust gas.

As the method of detection of the flow rate of the exhaust gas, for example, a map of the flow rate of the exhaust gas is stored as a function of the speed of the internal combustion engine and temperature of the exhaust gas in the electronic control unit 30. It is possible to detect the speed of the internal combustion engine and the temperature of the exhaust gas and use the speed of the internal combustion engine and the temperature of the exhaust gas as the basis to estimate the flow rate of the exhaust gas.

Alternatively, it is possible to reduce the amount of feed of the fuel in one combustion operation, the smaller the flow rate of the exhaust gas. For example, referring to FIG. 3, it is possible to shorten the time from the timing $t_3$ to the timing $t_4$ in one fuel combustion operation. By reducing the amount of feed of fuel per operation, it is possible to reduce the amount of combustion gas which is generated by combustion of fuel. Alternatively, it is possible to reduce the gas pressure occurring due to the combustion of fuel and possible to reduce the distance over which the combustion gas proceeds through the engine exhaust passage as backflow. Due to this control as well, it is possible to have substantially all of the combustion gas which proceeds to the upstream side from the glow plug return past the glow plug, then perform the next fuel combustion operation. It is therefore possible to effectively suppress the production of smoke.

In the first operational control and the second operational control, after the pulsation of the exhaust gas converges, the next fuel combustion operation is started, but the invention is not limited to this. It is also possible to start the next fuel combustion operation when pulsation of the exhaust gas residually continues.

Figure 6:
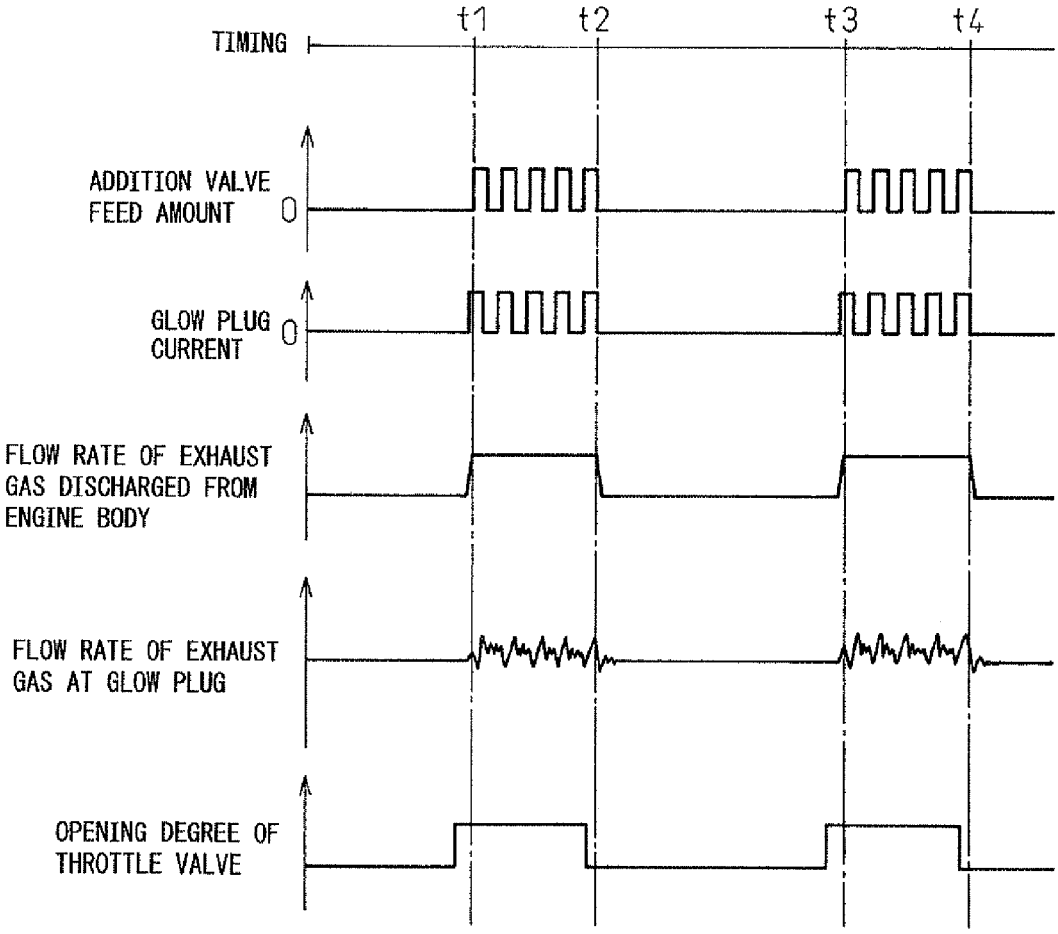
FIG. 6 is a time chart of a third operating control in Embodiment 1.

FIG. 6 shows a time chart of a third operational control in the present embodiment. In the third operational control, in the period from the timing $t_1$ to the timing $t_2$, a fuel combustion operation by first operational control is performed several times. After this, in the period from the timing $t_3$ to the timing $t_4$, the fuel combustion operation by the first operational control is performed several times. In this way, it is also possible to repeatedly perform control for intermittent combustion operations a plurality of times at predetermined time intervals.

Next, a fourth operational control in the present embodiment will be explained. The fourth operational control makes the air-fuel ratio of the exhaust gas which flows into the exhaust treatment device 55 the stoichiometric air-fuel ratio or rich based on demands of the exhaust treatment device 55. In the fourth operational control, the case where the exhaust treatment device 55 includes an $NO_x$ storage reduction catalyst is illustrated. In the present invention, the ratio of the air and fuel (hydrocarbons) in the exhaust gas which is fed to the engine intake passage, combustion chambers, or engine exhaust passage is called the "air-fuel ratio (A/F) of the exhaust gas".

The $NO_x$ storage reduction catalyst (NSR) is for example comprised of a substrate on which a catalyst carrier made of alumina is carried. On the surface of the catalyst carrier, a precious metal catalyst is carried dispersed. On the surface of the catalyst carrier, a layer of an $NO_x$ absorbent is formed. As the precious metal catalyst, for example, platinum Pt is used. As the ingredient forming the $NO_x$ absorbent, for example, at least one selected from an alkaline earth metal, barium Ba or another alkali earth, or a rare earth may be used.

The $NO_x$ storage reduction catalyst is a catalyst which temporarily stores the $NO_x$ which is included in the exhaust gas which is discharged from the engine body 1, releases the stored $NO_x$, and converts it to $N_2$ at that time. The $NO_x$ storage reduction catalyst stores the $NO_x$ at the time the air-fuel ratio of the exhaust gas is lean. When the stored amount of $NO_x$ reaches the allowable amount, the air-fuel ratio of the exhaust gas is made rich or the stoichiometric air-fuel ratio to make the stored $NO_x$ be released. In this way, $NO_x$ release control is performed.

The exhaust gas of the internal combustion engine sometimes contains sulfur oxides ($SO_x$). In this case, the $NO_x$ storage reduction catalyst stores $NO_x$ and simultaneously stores $SO_x$. If $SO_x$ is stored, the storable amount of $NO_x$ falls. The $NO_x$ storage reduction catalyst suffers from so-called sulfur poisoning. To eliminate the sulfur poisoning, sulfur poisoning recovery treatment is performed for releasing the $SO_x$. In the sulfur poisoning recovery treatment, in the state raising the temperature of the $NO_x$ storage reduction catalyst, the air-fuel ratio of the exhaust gas is made rich or the stoichiometric air-fuel ratio to release the $SO_x$. In this way, $SO_x$ release control is performed.

In the present embodiment, when raising the temperature in the control for the release of $SO_x$, unburned fuel can be fed from the fuel addition valve 15 and made to burn so as to quickly make the temperature of the $NO_x$ storage reduction catalyst rise.

Next, control of the air-fuel ratio of the exhaust gas to the stoichiometric air-fuel ratio or rich in $NO_x$ release control or $SO_x$ release control of the $NO_x$ storage reduction catalyst will be explained.

Figure 7:
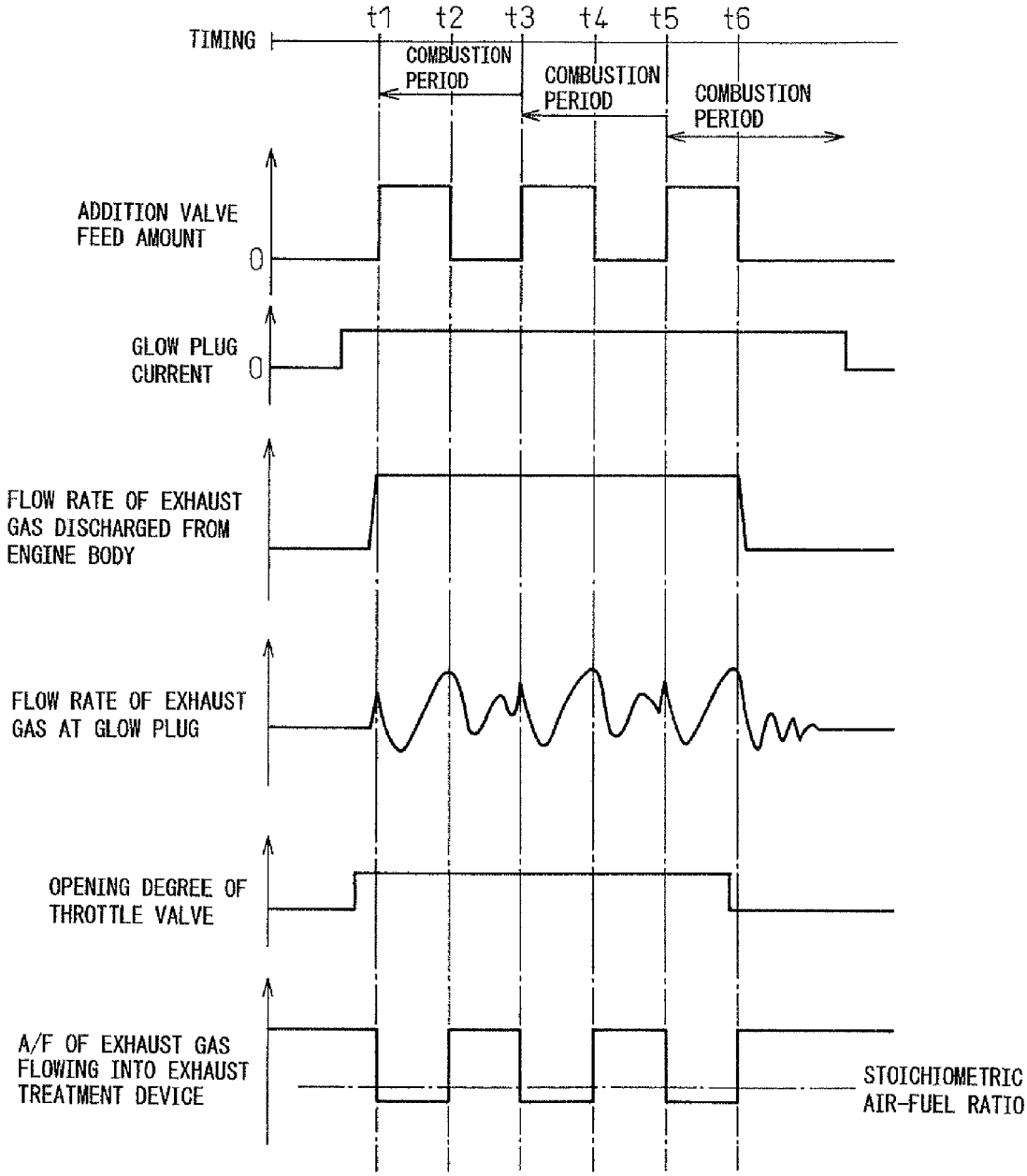
FIG. 7 is a time chart of a fourth operating control in Embodiment 1.

FIG. 7 is a time chart of the fourth operational control in the present embodiment. Below, mainly $NO_x$ release control will be explained, but for $SO_x$ release control as well, the same control as with $NO_x$ release control may be used to make the air-fuel ratio of the exhaust gas the stoichiometric air-fuel ratio or rich.

In the fourth operational control, a plurality of fuel combustion operations are intermittently performed. From the timing $t_1$ to the timing $t_6$, control is performed to increase the flow rate of exhaust gas which is discharged from the engine body. In the fourth operational control, current is run through the glow plug through the period of the plurality of fuel combustion operations.

In the period from the timing $t_1$ to the timing $t_2$, the period from the timing $t_3$ to the timing $t_4$, and the period from the timing $t_5$ to the timing $t_6$, unburned fuel is fed from the fuel addition valve 15 to make the fuel burn. During those periods, the air-fuel ratio of the exhaust gas which flows into the $NO_x$ storage reduction catalyst is made rich.

By making the fuel burn at the upstream side of the exhaust treatment device, it is possible to reform the fuel used as the reducing agent which is fed to the exhaust treatment device. For example, it is possible to make the fuel burn to reform the heavy unburned fuel and produce light unburned fuel. The exhaust treatment device can be fed with a light reducing agent superior in reduction ability. In the present embodiment, it is possible to efficiently release $NO_x$ or $SO_x$ in $NO_x$ release control or $SO_x$ release control.

In the fourth operational control, the period from the timing $t_2$ to the timing $t_3$ is set as the interval between fuel feed operations. The first fuel feed operation is stopped at the timing $t_2$. However, at the upstream side of the glow plug 51, the burning gas or unburned fuel remains and combustion is continued. At the timing $t_3$ where the previous fuel combustion operation residually continues, the next fuel feed operation is performed. That is, the current fuel combustion operation is started during the period where the previous combustion operation residually continues. Similarly, the feed of fuel is stopped at the timing $t_4$, and the next fuel combustion operation is started at the timing $t_5$ when the previous fuel combustion operation residually continues.

In the fourth operational control, when combustion of fuel residually continues, the next fuel combustion operation is started. The next fuel combustion operation is performed in the state where the amount of oxygen contained in the exhaust gas is suppressed. Liquid unburned fuel is fed in the state where fuel combustion is not promoted. For this reason, it is possible to lower the combustion temperature and suppress the generation of smoke. By making the air-fuel ratio of the exhaust gas rich in this way, it is possible to suppress the generation of smoke by starting the next combustion of fuel during the period when combustion is still continuing.

The flow regulating device in the present embodiment includes a throttle valve which is arranged in the engine intake passage, but the invention is not limited to this. It may also be formed so as to enable regulation of the flow rate of the exhaust gas which flows toward the glow plug.

The flow regulating device can include, for example, an exhaust gas recirculation system. Referring to FIG. 1, to reducing the opening degree of the EGR control valve 19, the amount of recirculation of the exhaust gas becomes smaller. As a result, it is possible to temporarily increase the flow rate of exhaust gas which flows toward the glow plug 51. Further, the flow regulating device may also include a bypass channel which bypasses the glow plug 51 and fuel addition valve 15. This bypass channel, for example, has a flow regulator arranged inside it. By reducing an opening degree of the flow regulator in the bypass channel from a predetermined opening degree, it is possible to increase the flow rate of the exhaust gas toward the glow plug.

Further, the fuel feed device in the present embodiment includes a fuel addition valve which injects fuel to the inside of the exhaust pipe, but the invention is not limited to this. It is possible to employ any device which can feed fuel into the engine exhaust passage. In particular, it is possible to effectively suppress smoke in an engine exhaust purification system of an internal combustion engine which directly injects fuel into the exhaust passage.

The ignition device in the present embodiment includes a glow plug, but the invention is not limited to this. It is also possible to employ any device which can ignite the fed unburned fuel. For example, the ignition device may include a spark plug, ceramic heater, etc. As the timing for starting to run current through the ignition device, it is possible to employ any timing at which fuel can be burned.

Further, in the present embodiment, the explanation was given with reference to diesel oil as an example of liquid fuel, but the liquid fuel is not limited to this. It is possible to employ any fuel which generates smoke. For example, it is possible to employ fuel containing carbon. As such a liquid fuel, gasoline, kerosene, heavy oil, alcohol, etc. may be illustrated.

In the present embodiment, the explanation was given with reference to a compression ignition type of internal combustion engine as an example, but the invention is not limited to this. The present invention can also be applied to a spark ignition type of internal combustion engine.

Embodiment 2

Referring to FIG. 8 to FIG. 11, an exhaust purification system of an internal combustion engine in Embodiment 2 will be explained. The exhaust purification system of an internal combustion engine of the present embodiment, in the same way as in Embodiment 1, causes the flow rate of the exhaust gas to increase when the fuel should be ignited or when the fuel is being burned. The exhaust purification system in the present embodiment has a member for adjusting the flow of the exhaust gas arranged near the ignition device.

Figure 8:
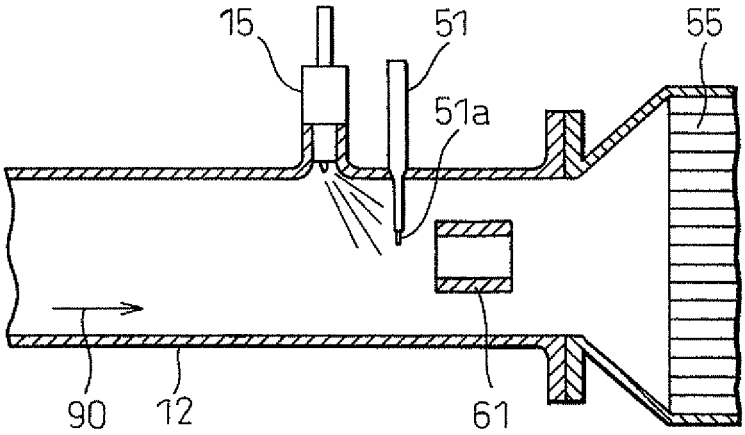
FIG. 8 is an enlarged partial cross-sectional view of a part of a glow plug in a first exhaust purification system in Embodiment 2.

FIG. 8 is an enlarged partial cross-sectional view of a part of a glow plug of the first exhaust purification system in the present embodiment. The first exhaust purification system is provided with a tubular member 61 as an auxiliary member which causes pressure loss of the exhaust gas.

The tubular member 61 is arranged inside of the engine exhaust passage at the downstream side of the glow plug 51. The tubular member 61 is arranged so that the axial direction becomes substantially parallel to the flow direction of the exhaust gas. The tubular member 61 is arranged at the downstream side of the heat generating part 51*a*. The tubular member 61 is arranged near the heat generating part 51*a*. By having the tubular member 61 arranged at the engine exhaust passage, the flow cross-sectional area of the engine exhaust passage becomes smaller. For this reason, a pressure loss of the exhaust gas occurs at the part of the tubular member 61.

In the first exhaust purification system of the present embodiment, the fuel addition valve 15 is formed so as to inject fuel toward the heat generating part 51*a* of the glow plug 51. By running current through the heat generating part 51*a* of the glow plug 51 and feeding fuel from the fuel addition valve 15, combustion of the unburned fuel is started. When the exhaust gas passes through the channel inside of the tubular member 61 and the surrounding channel outside of the tubular member, a pressure loss occurs. The gas pressure when the fuel is burned is partially reflected at the tubular member 61 and returned to the upstream side. For this reason, it is possible to bias the backflow of the exhaust gas.

In this way, by arranging an auxiliary member causing pressure loss of the exhaust gas at the downstream side of the glow plug 51, it is possible to bias the backflow of the exhaust gas which is generated when fuel fed from the fuel addition valve 15 burns and make the flow rate of the backflow of the exhaust gas larger. As a result, it is possible to effectively mix the fuel being burned and the exhaust gas.

The auxiliary member which causes the pressure loss of the exhaust gas is not limited to a tubular member. It is possible to employ any shape of member. For example, the auxiliary member may include a columnar member which extends substantially parallel with the direction of extension of the exhaust pipe, a member at which lattice like channels are formed, a member having a catalyst, etc.

Further, as the auxiliary member, a plate shaped member can be employed. A plate shaped member has a maximum area surface where the area becomes the maximum. The plate shaped member can be arranged so that the maximum area surface becomes substantially vertical to the flow direction of the exhaust gas. Due to this configuration, the gas pressure when the unburned fuel is burned at the glow plug can be reflected at the plate shaped member and the backflow of the exhaust gas at the engine exhaust passage can be biased.

Figure 9:
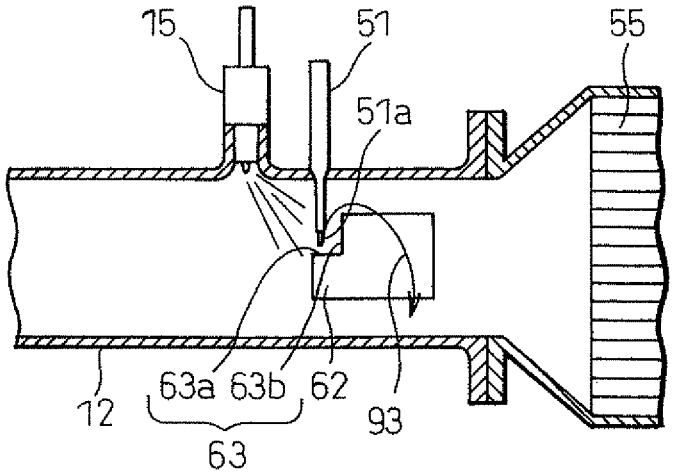
FIG. 9 is an enlarged partial cross-sectional view of a part of a glow plug in a second exhaust purification system in Embodiment 2.
Figure 10:
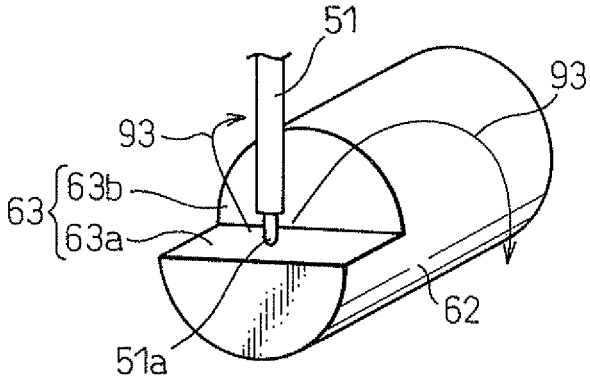
FIG. 10 is a schematic perspective view of a rod shaped member and glow plug of a second exhaust purification system in Embodiment 2.

FIG. 9 is an enlarged partial cross-sectional view of a glow plug of the second exhaust purification system in the present embodiment. FIG. 10 is a schematic perspective view of a glow plug and rod shaped member of a second exhaust purification system in the present embodiment. Referring to FIG. 9 and FIG. 10, in the second exhaust purification system, as the member for adjusting the flow of gas, the rod shaped member 62 is arranged. The rod shaped member 62 in the present embodiment is formed in a cylindrical shape. The rod shaped member 62 is arranged to extent substantially parallel to the flow direction of the exhaust gas.

The rod shaped member 62 has a cutaway part 63 which has a partially cutaway shape. The cutaway part 63 is formed at the end at the upstream side in the flow direction of the exhaust gas. The cutaway part 63 in the present embodiment has a surface 63*a* which is cut along the direction substantially parallel to the axial direction of the rod shaped member 62 and a surface 63*b* which is cut in a direction substantially perpendicular to the axial direction of the rod shaped member 62. In the present embodiment, the surfaces 63*a*, 63*b* are formed in a flat shape, but the invention is not limited to this. They may also be formed in curved shapes.

The heat generating part 51*a* of the glow plug 51 is arranged inside of the region in which the cutaway part 63 is formed. That is, when there is no cutaway part 63, the heat generating part 51*a* is arranged to be positioned inside of the rod shaped member 62. The heat generating part 51*a* is arranged so that the region in the shadow when projected along the axial direction of the rod shaped member 62 is included in the surface 63*b*. The heat generating part 51*a* is arranged so that the region which becomes in the shadow when projected in a direction vertical to the axial direction of the rod shaped member 62 is included in the surface 63*a*.

In the second exhaust purification system, the combustion gas which is burned near the heat generating part 51*a* is reflected at the surface 63*a* parallel to the axial direction of the rod shaped member 62. In the example of FIG. 9 and FIG. 10, this combustion gas is reflected in a direction in which the glow plug 51 is inserted in the diametrical direction of the exhaust pipe 12. After this, the combustion gas, while continuing to burn, proceeds along the exhaust passage formed between the exhaust pipe 12 and the rod shaped member 62 toward the downstream side of the exhaust pipe 12. As shown by the arrow 93, a flow is formed which swirls around the rod shaped member 62. Due to this swirling flow, the fuel being burned and the exhaust gas can be more effectively mixed, so the combustibility is improved. As a result, the generation of smoke can be more effectively suppressed.

Furthermore, at the surface 63*b* vertical to the axial direction of the rod shaped member 62, the gas pressure when the fuel is burned is reflected and part of the combustion gas is returned to the upstream side. As a result, it is possible to bias the backflow of the exhaust gas. It is possible to more effectively mix the unburned fuel and exhaust gas by this backflow as well and possible to more effectively suppress the generation of smoke.

By forming the cutaway part 63 at the end of the upstream side of the rod shaped member, it is possible to make the channel sandwiched between the rod shaped member and the exhaust pipe at the downstream side of the cutaway part 63 longer and form the swirl flow more reliably. The cutaway part 63 is not limited to the end at the upstream side of the rod shaped member and can be formed at any position.

Figure 11:
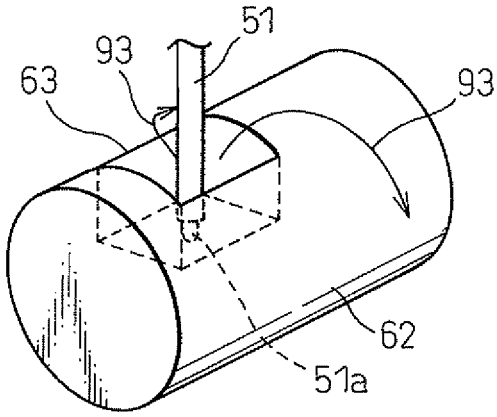
FIG. 11 is a schematic perspective view of a rod shaped member and glow plug of a third exhaust purification system in Embodiment 2.

FIG. 11 is a schematic perspective view of a glow plug and rod shaped member in a third exhaust purification system in the present embodiment. The rod shaped member 62 in the third exhaust purification system includes a cutaway part 63 formed at the side surface substantially parallel to the axial direction. The cutaway part 63 of the third exhaust purification system is formed to be recessed from the surface. The cutaway part 63 is formed to a size able to put the heat generating part 51*a* of the glow plug 51 in it. The heat generating part 51*a* is arranged inside of the region in which the cutaway part 63 is formed.

In the third exhaust purification system as well, when combustion of the fuel is started, as shown by the arrow 93, it is possible to form a flow of exhaust gas which swirls around the rod shaped member 62 and makes it possible to sufficiently mix the fuel and the exhaust gas. As a result, it is possible to more effectively suppress production of smoke.

The rod shaped member in the present embodiment is formed into a cylindrical shape, but the invention is not limited to this. It is possible to employ any shape which forms a swirling flow of exhaust gas. In the shape of the cutaway part as well, it is possible to employ any shape forming a reflected swirling flow of exhaust gas.

The rest of the configuration, action, and effects are similar to Embodiment 1, so the explanations will not be repeated here.

The above embodiments may be suitably combined. In the above figures, the same or corresponding parts are assigned the same reference notations. Note that the above embodiments are illustrations and do not limit the invention. Further, the embodiments include changes shown in the claims.

REFERENCE SIGNS LIST

1 . . . engine body
2 . . . combustion chamber
12 . . . exhaust pipe
15 . . . fuel addition valve
18 . . . EGR passage
30 . . . electronic control unit
51 . . . glow plug
51*a* . . . heat generating part
55 . . . exhaust treatment device
61 . . . tubular member
62 . . . rod shaped member
63 . . . cutaway part
63*a*, 63*b* . . . surface

The invention claimed is:

1. An exhaust purification system of an internal combustion engine, the exhaust purification system comprising:

an exhaust treatment device arranged in an engine exhaust passage which purifies exhaust, a fuel feed device arranged at an upstream side from the exhaust treatment device, and which feeds fuel to the engine exhaust passage, an ignition device which causes fuel, which is fed from the fuel feed device, to ignite, and a flow regulating device which regulates a flow rate of exhaust gas which flows toward the ignition device, wherein the fuel feed device is formed so as to feed liquid fuel, the system has an operating region in which due to the fuel which is fed to the engine exhaust passage burning, backflow of the exhaust gas occurs, fuel is made to burn in the operating region in which backflow of the exhaust gas occurs and further control is performed to make the flow rate of the exhaust gas increase during a period from when combustion of fuel should be started to when combustion of the fuel ends.

2. An exhaust purification system of an internal combustion engine as set forth in claim 1, wherein the flow regulating device is used to decrease the flow rate of the exhaust gas immediately after the feed of fuel is stopped.

3. An exhaust purification system of an internal combustion engine as set forth in claim 1, wherein the fuel feed device is controlled to intermittently burn the fuel a plurality of times, and the smaller the flow rate of the exhaust gas, the longer an interval between feed of fuel is made.

4. An exhaust purification system of an internal combustion engine as set forth in claim 1, wherein the fuel feed device is controlled to intermittently burn the fuel a plurality of times, and the smaller the flow rate of the exhaust gas, the smaller a feed amount of fuel is made each time.

5. An exhaust purification system of an internal combustion engine as set forth in claim 1, wherein the fuel feed device is controlled to intermittently burn the fuel a plurality of times and, when fuel is fed from the fuel feed device and an air-fuel ratio of the exhaust gas flowing into the exhaust treatment device is made a stoichiometric air-fuel ratio or rich, the combustion of fuel a current time is started when combustion of fuel fed a previous time is still continuing.

6. An exhaust purification system of an internal combustion engine as set forth in claim 1, wherein the system is provided with an auxiliary member which is arranged at an inside of the engine exhaust passage and which causes a pressure loss of exhaust gas, the ignition device has a heat generating part, the fuel feed device is formed so as to feed fuel toward the heat generating part, and the auxiliary member is arranged at a downstream side of the heat generating part near to the heat generating part.

7. An exhaust purification system of an internal combustion engine as set forth in claim 1, wherein the system is provided with a rod shaped member which is arranged at an inside of the engine exhaust passage and which extends in a flow direction of the exhaust gas, the ignition device has a heat generating part, the rod shaped member has a cutaway part which has a shape which is partially cut away, the fuel feed device is formed so as to feed fuel toward the heat generating part, and the heat generating part is arranged at an inside of a region in which the cutaway part is formed.

* * * * *